US008508323B2

(12) United States Patent
Ishikawa et al.

(10) Patent No.: US 8,508,323 B2
(45) Date of Patent: Aug. 13, 2013

(54) TRANSFORMER

(75) Inventors: Masamichi Ishikawa, Hekinan (JP); Shinjiro Yasui, Toyoto (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/231,034

(22) Filed: Sep. 13, 2011

(65) Prior Publication Data

US 2012/0062347 A1 Mar. 15, 2012

(30) Foreign Application Priority Data

Sep. 14, 2010 (JP) ..... 2010-205264

(51) Int. Cl.

| | |
|---|---|
| ***H01F 21/02*** | (2006.01) |
| ***H01F 21/06*** | (2006.01) |
| ***H01F 27/28*** | (2006.01) |
| ***H01F 27/30*** | (2006.01) |

(52) U.S. Cl.

USPC ..... 336/147; 336/131; 336/170; 336/182; 336/208; 336/223

(58) Field of Classification Search

USPC ..... 336/182, 208, 223

See application file for complete search history.

(56) References Cited

U.S. PATENT DOCUMENTS

| | | | | |
|---|---|---|---|---|
| 5,034,717 | A * | 7/1991 | Shinkai | 336/223 |
| 2008/0101097 | A1 | 5/2008 | Kawasaki et al. | |

FOREIGN PATENT DOCUMENTS

| | | |
|---|---|---|
| JP | 10-275725 | 10/1998 |
| JP | 2008-113532 | 5/2008 |
| JP | 2010-093153 | 4/2010 |
| JP | 2010-098207 | 4/2010 |

OTHER PUBLICATIONS

Enlgish translation of JP2010093153A.*

Japanese Office Action dated Jul. 31, 2012, issued in corresponding Japanese Application No. 2010-205264 with English translation.

Office Action issued in Japanese Patent Appl. 2010-205264 on Mar. 12, 2013, along with English Language Translation.

* cited by examiner

*Primary Examiner* — Mohamad Musleh
*Assistant Examiner* — Ronald Hinson
(74) *Attorney, Agent, or Firm* — Nixon & Vanderhye P.C.

(57) ABSTRACT

A transformer has primary coils and secondary coils that are arranged in a laminated manner in a direction of a winding axis and are mutually insulated. The secondary coils are composed of conducting plates in a plurality of layers arranged in the laminated manner in the direction of the winding axis, and the conducting plates are electrically connected in series. Connecting portions between the each conducting plates are arranged in an inner space of the primary coils.

6 Claims, 8 Drawing Sheets

TRANSFORMER

CROSS-REFERENCE TO RELATED APPLICATION

This application is based on and claims the benefit of priority from earlier Japanese Patent Application No. 2010-205264 flied Sep. 14, 2010, the description of which is incorporated herein by reference.

TECHNICAL FIELD

The present disclosure relates to a transformer that steps-up or steps-down an input voltage and outputs.

BACKGROUND

For a transformer that has a primary coil, a secondary coil, and a core that composes a magnetic circuit of a magnetic field generated by energizing the above-mentioned primary coil, transformers disclosed in JP-A-2010-98207, JP-A-2010-93153, and JP-A-2008-113532 are proposed, for instance.

These transformers are built into a power-supply unit such as a DC-DC converter, and step-up or step-down an input voltage.

When the transformer step-up or step down ratio is adjusted, a ratio of winding number between the primary coil and the secondary coil is adjusted.

Here, although a ratio of transformation of the transformer can be adjusted by changing the number of windings of the primary coil, semiconductor elements etc. that are connected with the primary coil should be changed because an inductance of the primary coil changes, therefore other parts in the power-supply unit that the transformer is assembled require design changing in specifications.

Then, it is desired to avoid changing the transformer design by adjusting the ratio of transformation by changing the number of windings of the secondary coil without changing the number of windings of the primary coil.

However, in the transformers disclosed in JP-A-2010-98207, JP-A-2010-93153, and JP-A-2008-113532, the number of winding of secondary coils for every transformer is one turn, and a transformer with a winding of plural layers is not disclosed.

Further, it is necessary to prepare a plurality of conducting plates that composes the secondary coil and connect the conducting plates in series mutually in order to make the secondary coil with plural windings as if to be composed in a plurality of layers in the direction of a winding axis.

At this time, a projected-shape of the transformer seen from the direction of the winding axis changes when connecting portions are disposed in an outer space of the primary coil and the secondary coil, and a projected area becomes large, as well.

Then, a shape of a space for disposing the transformer in the power-supply unit such as the DC-DC converter equipped with the transformer changes, and there is a problem that an area of the space for disposing the transformer becomes large.

Especially, when changing the design of the power-supply unit that changes only the ratio of transformation of the transformer, it is preferred that only the design of the transformer is changed, and other parts in the power-supply unit remain unchanged completely.

However, when the external outline (projected shape) seen from the direction of the winding axis changes by having the above-mentioned connecting portions provided, this obstructs an efficient design change.

SUMMARY

An embodiment provides a transformer that can increase a number of windings of secondary coils so as not to influence a projected shape seen from a direction of a winding axis.

In a transformer according to a first aspect, the transformer includes primary coils and secondary coils that are arranged in a laminated manner in a direction of a winding axis and are mutually insulated.

The secondary coils are composed of conducting plates in a plurality of layers arranged in the laminated manner in the direction of the winding axis, the conducting plates are electrically connected in series, and connecting portions between the each conducting plates are arranged in an inner space of the primary coils.

In the transformer mentioned above, the secondary coils are composed by the plural layers of the conducting plates arranged in the laminated manner in the direction of the winding axis.

By this, the number of windings of the secondary coils can be configured easily to plural windings, and the ratio of transformation of the transformer can be adjusted easily.

Moreover, the connecting portions between the each conducting plates are disposed in the inner space of the primary coils.

Therefore, the connecting portions never influence the projected shape of the transformer seen from the winding axis direction.

That is, the projected shape of the transformer will not change by disposing the connecting portions that are needed for the secondary coils with the plural number of windings.

Therefore, even if the number of windings of the secondary coils is plural, the projected shape can be maintained as the case of the transformer with a single winding.

According to the present disclosure mentioned above, the transformer that can increase the number of windings of the secondary coils so as not to influence the projected shape seen from the direction of the winding axis can be provided.

In the transformer according to a second aspect, an upper core and a lower core that compose a magnetic circuit of a magnetic field generated by energizing the primary coils are disposed so as to sandwich the primary coils and the secondary coils from both sides in the winding axis direction, the lower core is composed of a plurality of divided cores that are arranged with a space between each other, and the connecting portions are arranged in the space between the divided cores.

In the transformer according to a third aspect, the secondary coils are composed by two layers of the conducting plates.

DETAILED DESCRIPTION OF THE PREFERRED EMBODIMENTS

A transformer in the embodiment of the present disclosure is explained by using FIG. 1 to FIG. 8.

Figure 1:
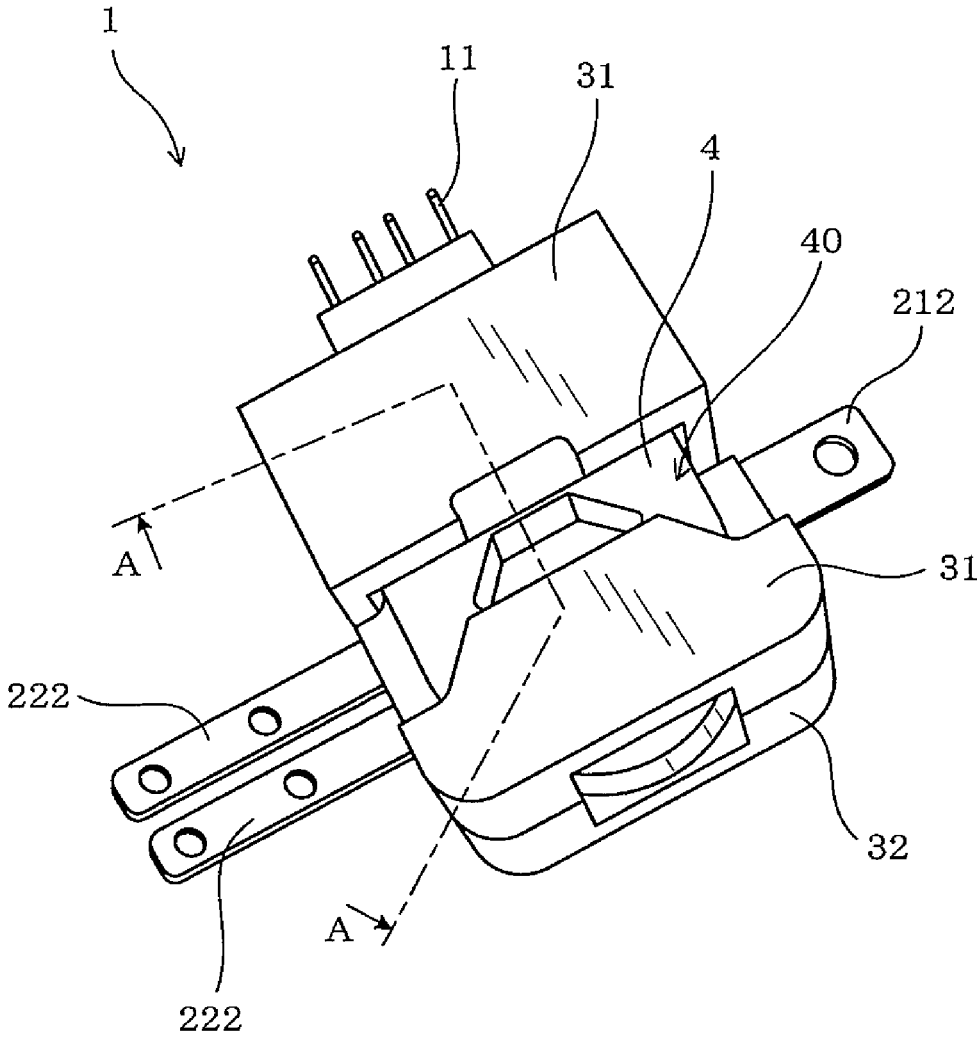
FIG. 1 shows a perspective view of a transformer seen from an upper core side in an embodiment.
Figure 2:
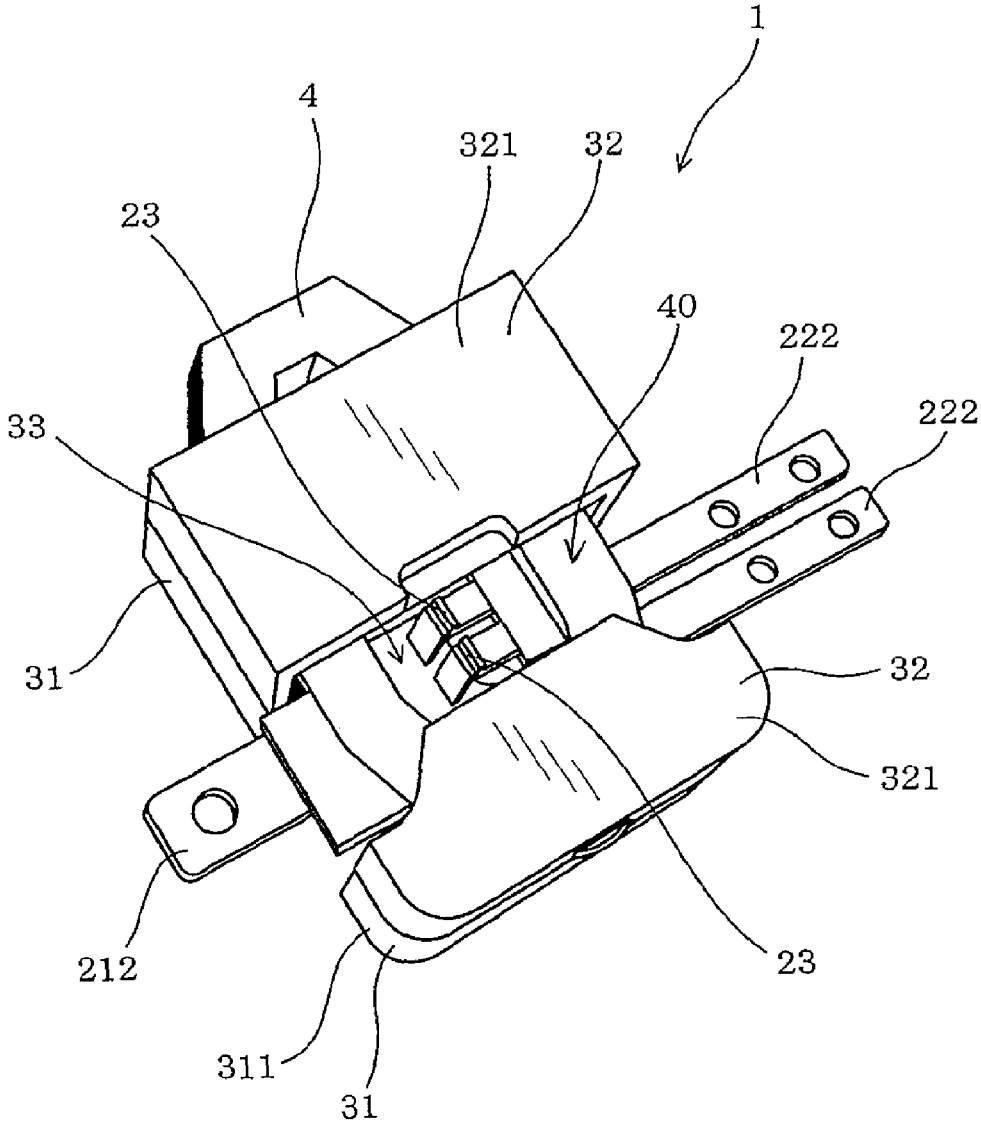
FIG. 2 shows s perspective view of the transformer seen from a lower core side in the embodiment.
Figure 3:
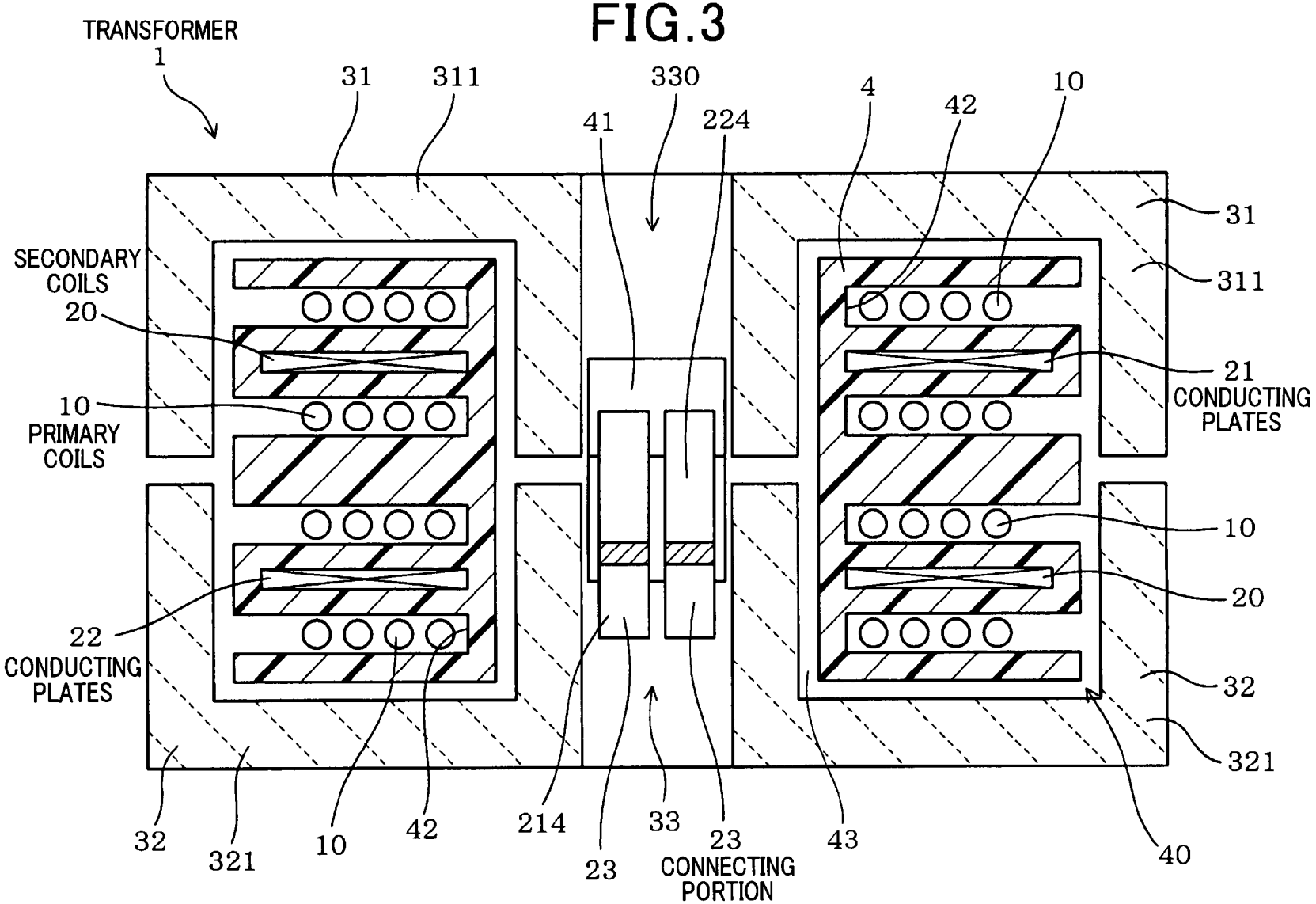
FIG. 3 shows a cross sectional view taken along a line A-A.

A transformer 1 of the present embodiment has primary coils 10 and secondary coils 20. The coils 10 and 20 are arranged in a laminated manner in a direction of a winding axis, and are mutually insulated as shown in FIG. 1 to FIG. 3.

The secondary coils 20 are composed of conducting plates 21 and 22 in a plurality of layers (two layers) arranged in the laminated manner in the direction of the winding axis, and the each conducting plates 21 and 22 are electrically connected in series.

Connecting portions 23 between the each conducting plates 21 and 22 are arranged in an inner space of the primary coils 10.

Moreover, an upper core 31 and a lower core 32 that compose a magnetic circuit of a magnetic field generated by energizing to the primary coils 10 are disposed so as to sandwich the primary coils 10 and the secondary coils 20 from both sides in the winding axis direction.

The lower core 32 is composed of a plurality (2 pieces) of divided cores 321 that are arranged with a space 33 between each other.

The connecting portions 23 are arranged in the space 33 between the divided cores 321.

It should be appreciated that the words "upper" and "lower" used for the upper core and the lower core do not limit the positions of the cores, but the words "upper" and "lower" are used expediently. Moreover, the upper core may also be composed of a plurality of divided cores that are arranged with a space between each other.

The primary coils 10 and the secondary coils 20 are wound around a bobbin 4 made of an insulator member such as resins in the transformer 1 of the present embodiment.

The primary coils 10 are composed by winding conductor lines that have an insulation coated on its outer surface.

Outer grooves 42 that support the primary coils 10 are formed on an outer surface of the bobbin 4. The outer grooves 42 are formed in four different places in the winding axis direction. The primary coils 10 are disposed in the outer grooves 42.

Moreover, the bobbin 4 has a penetration space 43 that penetrates in the winding axis direction in an inner side of the outer grooves 42.

The primary coils 10 and the secondary coils 20 are laminated alternately in the winding axis direction as shown in FIG. 3.

Then, the primary coils 10 arranged in the two places of the outer grooves 42 among the primary coils 10 arranged in the four places of the outer grooves 42 are arranged so as to sandwich the one of the conducting plates 21 of the secondary coils 20 from both sides in the winding axis direction, while the primary coils 10 arranged in the other two places of the outer grooves 42 are arranged so as to sandwich the other one of the conducting plates 21 of the secondary coils 20 from both sides in the winding axis direction.

Figure 6:
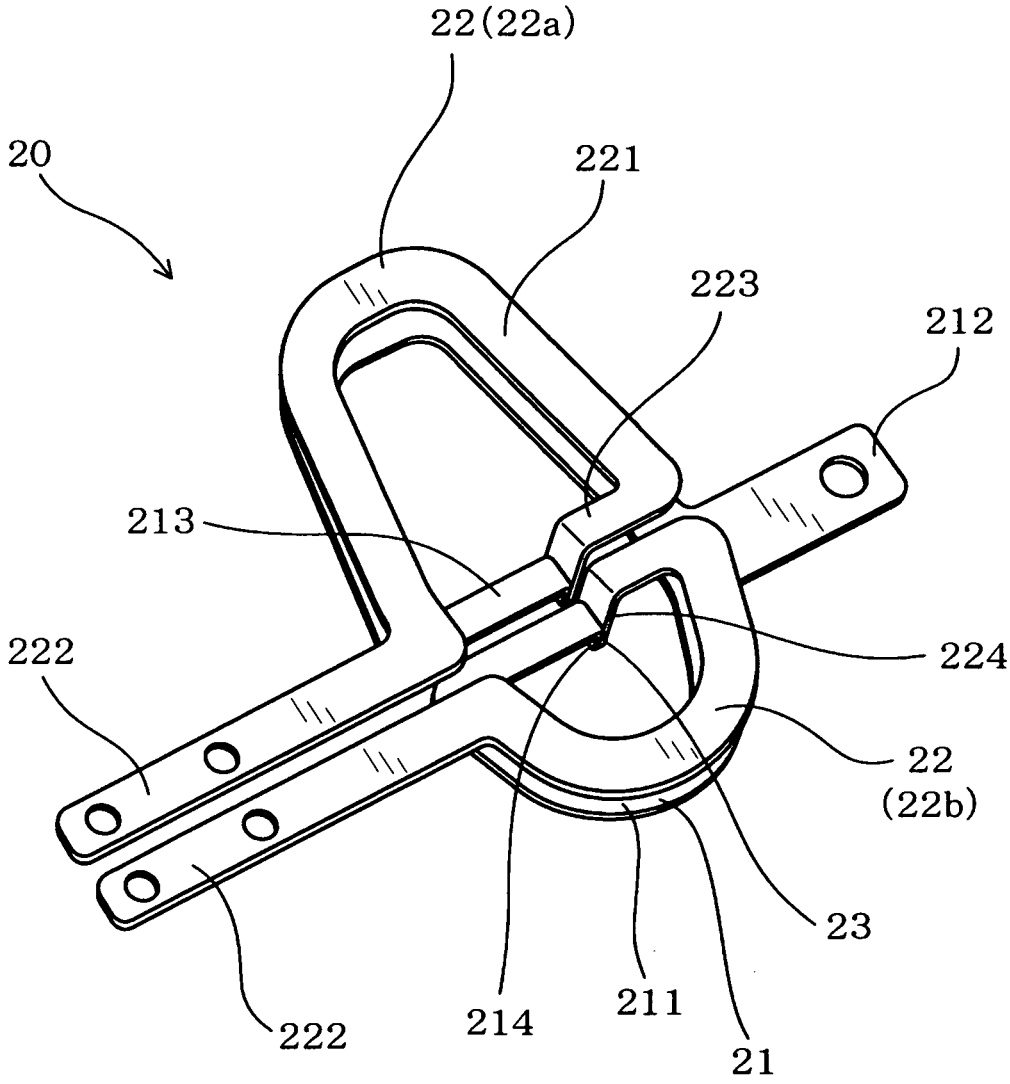
FIG. 6 shows a perspective view of a secondary coil seen from the upper side in the embodiment.
Figure 7:
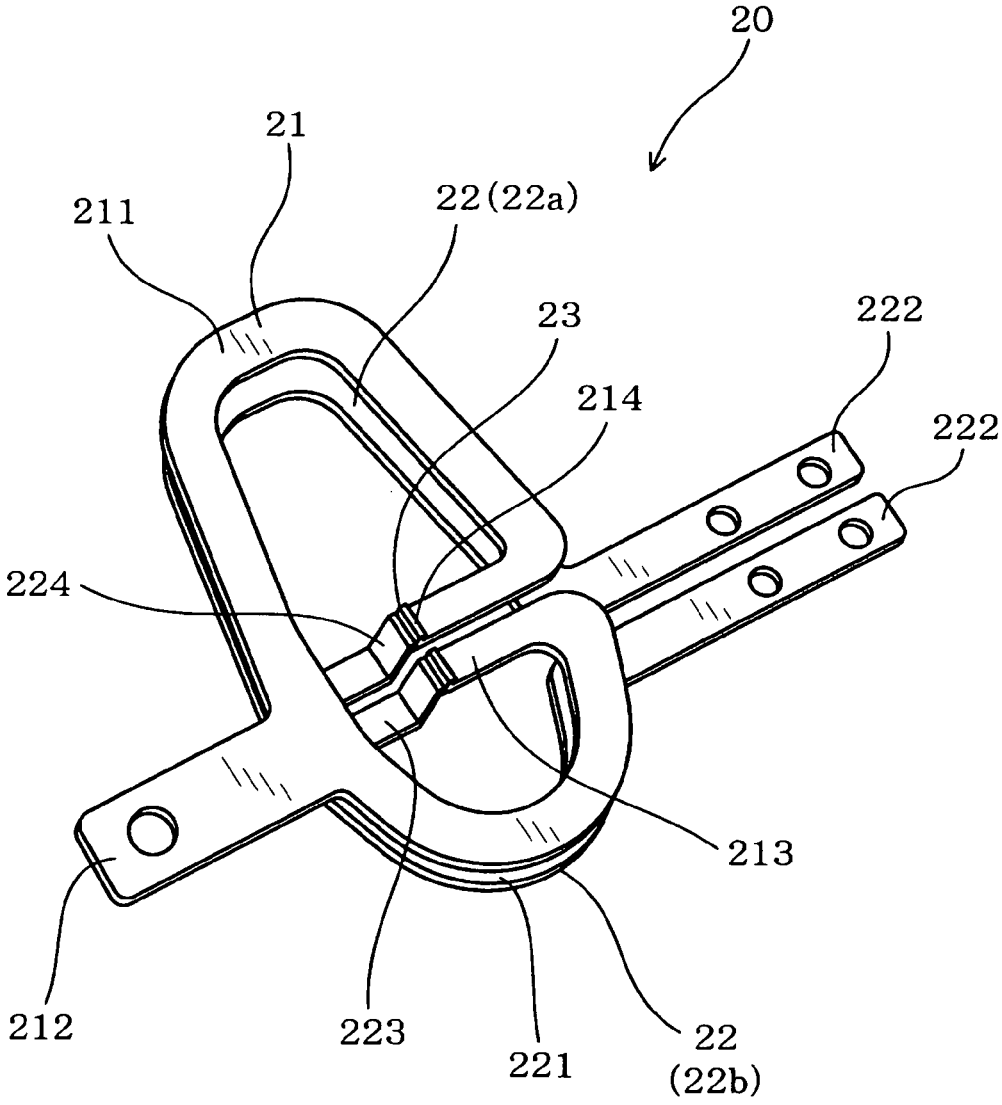
FIG. 7 shows a perspective view of the secondary coil seen from the lower layer side in the embodiment.

The secondary coils 20 are composed by two layers of the conducting plates 21 and 22 arranged in the laminated manner in the winding axis direction as shown in FIG. 6 and FIG. 7, and each conducting plates 21 and 22 are electrically connected in series.

Figure 4:
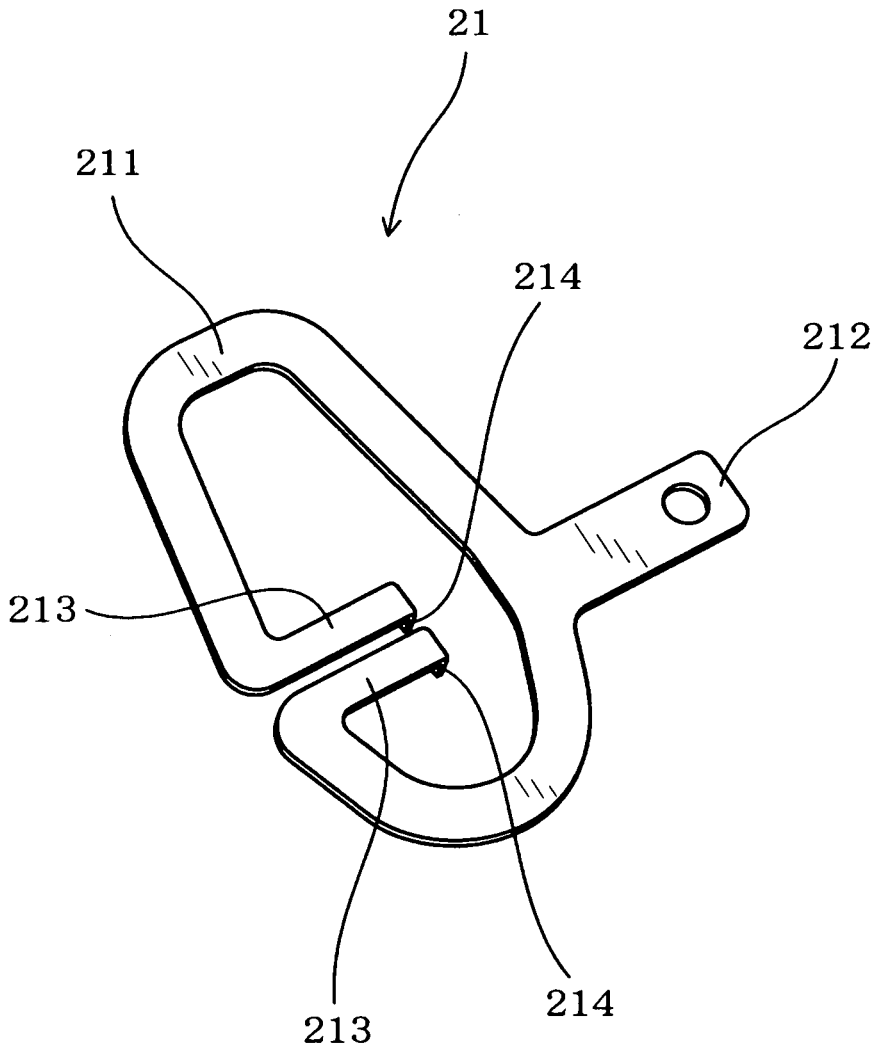
FIG. 4 shows a perspective view of a conducting plate of a lower layer in the embodiment.
Figure 5:
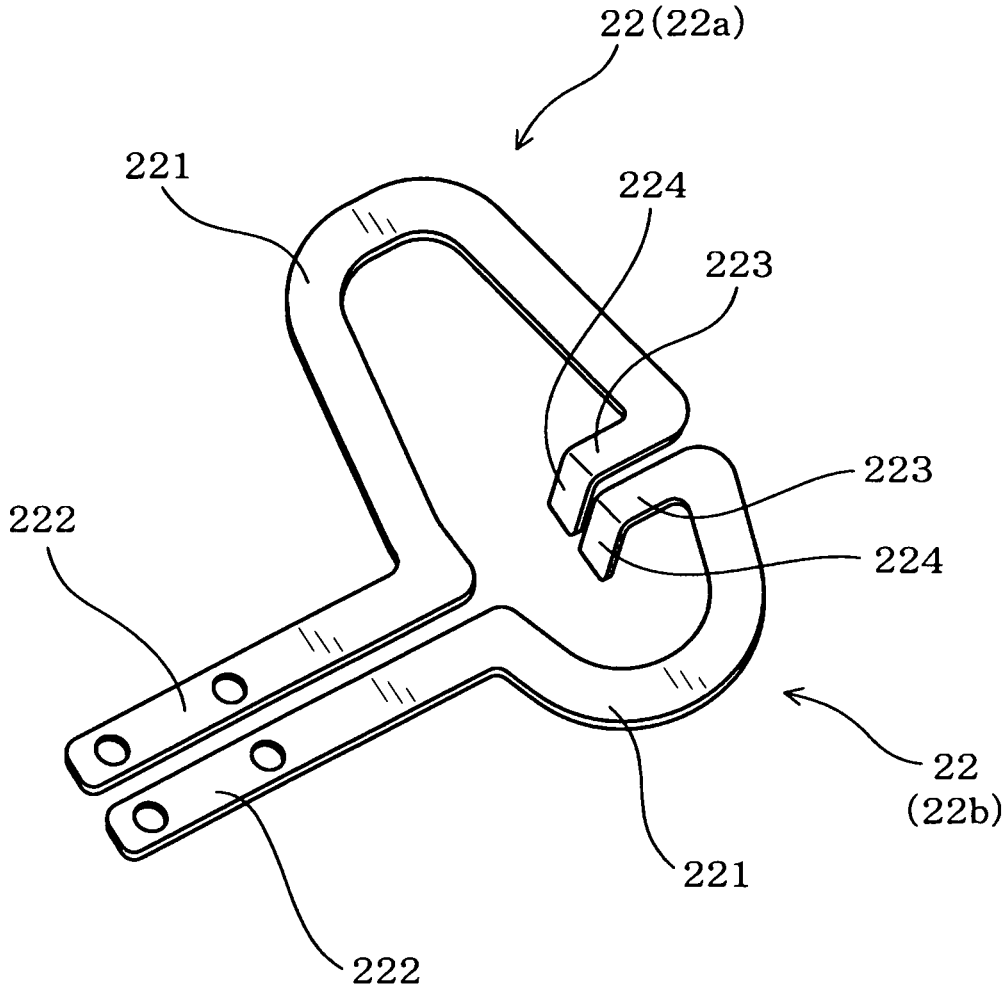
FIG. 5 shows a perspective view of a conducting plate of an upper layer in the embodiment.

That is, the conducting plate 21 shown in FIG. 4 and two conducting plate 22*a* and 22*b* shown in and FIG. 5 are mutually connected in series so that the secondary coils 20 shown in FIG. 6 and FIG. 7 are composed.

The conducting plate 21 (shown in FIG. 4) in one of the layers ("lower layer" hereafter) among the two layers of the conducting plates 21 and 22 has an annular portion 211, a terminal portion 212, inwardly-facing portions 213, and bent portions 214. The annular portion 211 is formed to a substantially annular shape with a gap between both ends. The terminal portion 212 projects from the annular portion 211 outwardly. The inwardly-facing portions 213 are extended inside the annular portion 211 from the both ends of the annular portion 211. The bent portions 214 are bent from the inwardly-facing portions 213 in the winding axis direction.

The conducting plate 21 has a flat-plate shape that extends in two dimensions excluding the bent portions 214.

The conducting plates 22 (shown in FIG. 5) in other one of the layers ("upper layer" hereafter) among the two layers of the conducting plates 21 and 22 are composed by a pair of conducting plates 22*a* and 22*b* that are mutually different member.

Each conducting plate 22*a* and 22*b* has a half annular portion 221, a terminal portion 222, an inwardly-facing portion 223, and a bent portion 224, respectively. The half annular portion 221 compose a half of the annular shape. The terminal portion 222 projects from one end of the half annular portion 221 outwardly. The inwardly-facing portion 223 extended inside the half annular portion 221 from another end of the half annular portion 221. The bent portion 224 is bent from the inwardly-facing portion 223 in the winding axis direction.

The conducting plate 22 has a flat-plate shape that extends in two dimensions excluding the bent portions 224.

As shown in FIG. 6 and FIG. 7, the conducting plates 21*a* and 22*b* as the upper layers are overlapped on the conducting plate 21 as the lower layer with a predetermined interval in the winding axis direction.

In addition, each bent portion 224 of the conducting plates 21*a* and 22*b* as the upper layer is overlapped onto the pair of the bent portions 214 of the conducting plate 21 as the lower layer, and both are connected mutually by welding, soldering, etc., for example.

As a result, the secondary coils 20 in the double-layered structure are obtained with the connected parts of the bent portions 214 and the bent portions 224 become the connecting portions 23.

The annular portions 211 and the half annular portions 221 of the secondary coils 20 are embedded into the bobbin 4.

The bobbin 4 has an inwardly-faced supporting portion 41 that supports the inwardly-facing portions 213 and 223 of the secondary coils 20. Then the primary coils 10 are wound around the outer grooves 42 of the bobbin 4.

Figure 8:
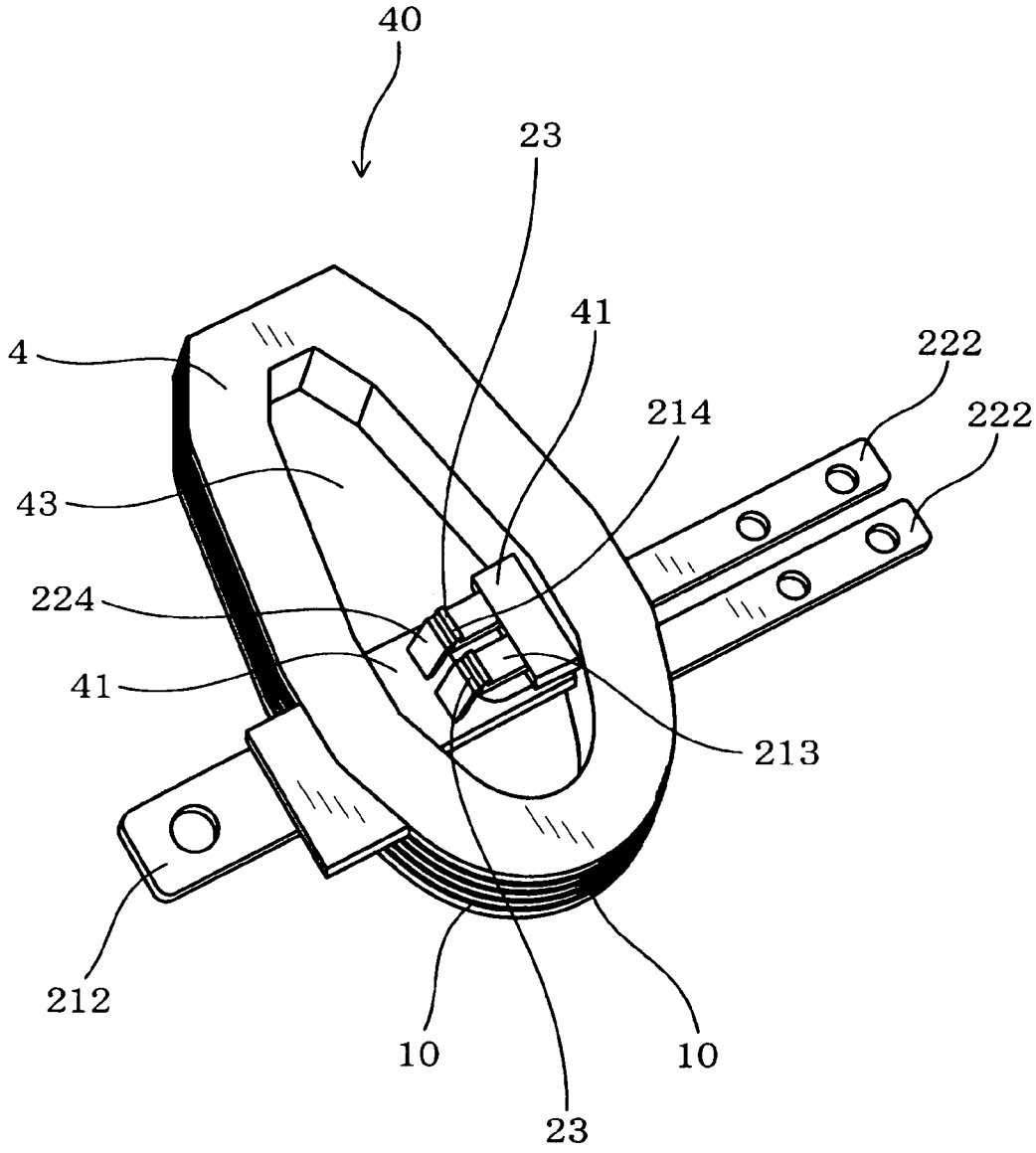
FIG. 8 shows a perspective view of a coil unit seen from the lower side in the embodiment.

As a result, a coil unit 40 that has the primary coils 10, the secondary coils 20, and the bobbin 4 that supports the coils 10 and 20 is obtained as shown in FIG. 3 and FIG. 8.

The upper core 31 and the lower core 32 made of the magnetic material are arranged to the coil unit 40 from both sides in the winding axis direction as shown in FIG. 1 FIG. 3.

Here, the upper core 31 and lower core 32 are made of two each of the divided cores 311 and 321, respectively.

The space 33 large enough to dispose the connecting portions 23 is formed at least between the pair of the divided cores 321 in the lower core 32.

In the present embodiment, another space 330 of the size equal with the above-mentioned space 33 is formed between the pair of the divided cores 311 in the upper core 31.

Further, the inwardly-faced supporting portion 41 of the bobbin 4 and the connecting portions 23 of the secondary coils 20 are arranged in the spaces 33 and 330.

The primary coils 10 is composed by projecting a terminal 11 outwardly from between the upper core 31 and lower core 32 as shown in FIG. 1. The terminal 11 is projecting outwardly from a part of the primary coils 10 wound around the bobbin 4.

Further, the secondary coils 20 are projecting the terminal portions 212 and 222 outwardly from between the upper core 31 and lower core 32.

Moreover, the connecting portions 23 are to be arranged inside the externals of the bobbin 4 seen from the winding axis direction.

The transformer 1 composed as mentioned above is built into the power-supply unit such as the DC-DC converter.

The operation and effect of the present embodiment is explained hereafter.

In the transformer 1 mentioned above, the secondary coils 20 are composed by the plural layers of the conducting plates 21 and 22 arranged in the laminated manner in the direction of the winding axis.

By this, the number of windings of the secondary coils 20 can be configured easily to plural windings, and the ratio of transformation of the transformer 1 can be adjusted easily.

Moreover, the connecting portions 23 between the each conducting plates 21 and 22 are disposed in the inner space of the primary coils 10.

Therefore, the connecting portions 23 never influence the projected shape of the transformer 1 seen from the winding axis direction.

That is, the projected shape of the transformer 1 will not change by disposing the connecting portions 23 that are needed for the secondary coils 20 with the plural number of windings.

Therefore, even if the number of windings of the secondary coils 20 is plural, the projected shape can be maintained as the case of the transformer 1 with a single winding.

As a result, since the projected shape of the transformer 1 seen from in the winding axis direction is not changed even if the ratio of the transformation of the transformer 1 is changed, for example, the disposing space need not be changed in the power-supply unit that the transformer 1 is assembled.

Therefore, the ratio of the transformation of the transformer 1 can be changed easily and at low cost without accompanying a substantial design change of the power-supply unit.

Moreover, the connecting portions 23 are disposed in the space 33 between the two divided cores 321 in the lower core 32.

Therefore, transformer 1 can be efficiently miniaturized preventing the interference of the connecting portions 23 and the lower core 32.

Furthermore, since the secondary coils 20 are composed by the two layers of the conducting plates 21 and 22, the complication of the composition of the transformer 1 can be suppressed as well as the enlargement of the size of the transformer 1 in the winding axis direction can be suppressed.

According to the present embodiment mentioned above, the transformer that can increase the number of windings of the secondary coils so as not to influence the projected shape seen from the direction of the winding axis can be provided.

It should be appreciated that although the secondary coils 20 having a double-layered structure is shown as the example in the above-mentioned embodiment, the secondary coils 20 may have more than three layers.

What is claimed is:

1. A transformer comprising:

primary coils and secondary coils that are arranged in a laminated manner in a direction of a winding axis and are mutually insulated; wherein, the secondary coils are composed of a plurality of conducting plates that are arranged in the laminated manner in the direction of the winding axis;

the plurality of conducting plates are electrically connected in series; and a first connecting portion of a first of the conducting plates extends inwardly from an inner side of the secondary coils toward a center of the secondary coils, and a second connecting portion of a second of the conducting plates extends inwardly from an inner side of the secondary coils toward a center of the secondary coils and couples to the first connecting portion adjacent the center of the secondary coil.

2. The transformer according to claim 1, wherein, an upper core and a lower core that compose a magnetic circuit of a magnetic field generated by energizing the primary coils are disposed so as to sandwich the primary coils and the secondary coils from both sides in the winding axis direction, the lower core is composed of a plurality of divided cores that are arranged with a space between each other, and the first and second connecting portions are arranged in the space between the divided cores.

3. The transformer according to claim 1, wherein a third connecting portion of the first of the conducting plates extends inwardly from an inner side of the secondary coils toward a center of the secondary coils, the first and third connecting portions comprising opposite ends of the first conducting plate.

4. The transformer according to claim 3, wherein a fourth connecting portion of a third conducting plate extend inwardly from the inner side of the secondary coils toward a center of the secondary coils and couples to the third connecting portion.

5. The transformer according to claim 4, wherein ends of the second and fourth connecting portions are bent relative to the plane of the second and third conducting plates.

6. The transformer according to claim 5, wherein ends of the first and third connecting portions couple to the bent portions of the second and fourth connecting portions.

* * * * *